US011858019B2

(12) United States Patent
Nikkuni et al.

(10) Patent No.: US 11,858,019 B2
(45) Date of Patent: Jan. 2, 2024

(54) SLAB MANUFACTURING METHOD AND CONTROL DEVICE

(71) Applicant: NIPPON STEEL CORPORATION, Tokyo (JP)

(72) Inventors: Daisuke Nikkuni, Tokyo (JP); Toshiyuki Shiraishi; Yutaka Sadano, Tokyo (JP); Masafumi Miyazaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 338 days.

(21) Appl. No.: 17/286,660

(22) PCT Filed: Oct. 21, 2019

(86) PCT No.: PCT/JP2019/041319
§ 371 (c)(1),
(2) Date: Apr. 19, 2021

(87) PCT Pub. No.: WO2020/085305
PCT Pub. Date: Apr. 30, 2020

(65) Prior Publication Data

US 2021/0362204 A1 Nov. 25, 2021

(30) Foreign Application Priority Data

Oct. 22, 2018 (JP) ..... 2018-198356

(51) Int. Cl.
*B21B 1/04* (2006.01)
*B21B 37/58* (2006.01)
(Continued)

(52) U.S. Cl.
CPC ..... *B21B 1/04* (2013.01); *B21B 37/58* (2013.01); *B22D 11/06* (2013.01); *B22D 11/12* (2013.01);
(Continued)

(58) Field of Classification Search
CPC ..... B21B 1/04; B21B 37/58; B21B 2001/028; B21B 37/66; B21B 1/00; B22D 11/06; B22D 11/12
See application file for complete search history.

(56) References Cited

U.S. PATENT DOCUMENTS 5,191,927 A * 3/1993 Terado ..... G01B 21/08 164/428
7,963,136 B2 * 6/2011 Flick ..... B21B 37/28 72/200
(Continued)

FOREIGN PATENT DOCUMENTS

CN 101443135 A 5/2009
JP S60-30508 A 2/1985
(Continued)

*Primary Examiner* — Ryan J. Walters
(74) *Attorney, Agent, or Firm* — Myers Wolin, LLC

(57) ABSTRACT

A slab manufacturing method in which casting drum housing screw-down system deformation characteristics which have been acquired prior to the start of slab casting and which indicate deformation characteristics of a housing configured to support a casting drum and deformation characteristics of a screw-down system configured to screw down the casting drum is used to calculate an estimated plate thickness at both end portions of a slab in a width direction thereof from Expression 1 ((estimated plate thickness on entry side of rolling mill)=(screw-down position of casting cylinder)+(elastic deformation of casting drum)+(casting drum housing screw-down system deformation)+(drum profile of casting drum)−(elastic deformation of casting drum at time of screw-down position zero-point adjustment)), an entry-side wedge ratio and an exit-side wedge ratio are calculated on the basis of the estimated plate thickness calculated from Expression 1.

6 Claims, 10 Drawing Sheets

(51) Int. Cl.

| | |
|---|---|
| ***B22D 11/06*** | (2006.01) |
| ***B22D 11/12*** | (2006.01) |
| *B21B 1/02* | (2006.01) |
| *B21B 37/66* | (2006.01) |
| *B21B 1/00* | (2006.01) |

(52) U.S. Cl.
CPC ..... *B21B 1/00* (2013.01); *B21B 37/66* (2013.01); *B21B 2001/028* (2013.01)

(56) References Cited

U.S. PATENT DOCUMENTS

| | | | | |
|---|---|---|---|---|
| 8,002,016 | B2 * | 8/2011 | Rees | B22D 11/0697 164/428 |
| 9,126,263 | B2 * | 9/2015 | Schwellenbach | B21B 13/22 |
| 2020/0406321 | A1 * | 12/2020 | Shiraishi | B21B 1/463 |
| 2021/0387249 | A1 * | 12/2021 | Nikkuni | B22D 11/168 |

FOREIGN PATENT DOCUMENTS

| | | | |
|---|---|---|---|
| JP | H01-166863 | A | 6/1989 |
| JP | H04-74084 | B2 | 11/1992 |
| JP | H09-168810 | A | 6/1997 |
| JP | 2000-343103 | A | 12/2000 |
| JP | 2000-343183 | A | 12/2000 |
| JP | 2003-39108 | A | 2/2003 |
| JP | 2008-161934 | A | 7/2008 |
| JP | 2013-75326 | A | 4/2013 |
| JP | 2017-196636 | A | 11/2017 |
| WO | 2007/101308 | A1 | 9/2007 |

* cited by examiner

SLAB MANUFACTURING METHOD AND CONTROL DEVICE

CROSS-REFERENCE TO RELATED APPLICATION

This application is a National Phase of PCT/JP2019/041319, filed on Oct. 21, 2019, and which designated the U.S., which claims priority to Japanese Patent Application No. 2018-198356, filed on Oct. 22, 2018. The contents of each are wholly incorporated herein by reference.

TECHNICAL FIELD

The present disclosure relates to a slab manufacturing method and a control device.

Priority is claimed on Japanese Patent Application No. 2018-198356, filed Oct. 22, 2018, the content of which is incorporated herein by reference.

BACKGROUND ART

For the production of metal strips (hereinafter referred to as "a slab"), for example, as described in Patent Document 1, a twin-drum type continuous casting device may be utilized. A twin-drum type continuous casting device continuously casts metal strips by a pair of casting drums for continuous casting (hereinafter referred to as "casting drums") being disposed parallel to each other, rotating facing circumferential surfaces of casting drums downward from above, injecting a molten metal into molten metal pool parts formed by the circumferential surfaces of these casting drums, and cooling and solidifying the molten metal on the circumferential surfaces of the casting drums. The pair of casting drums press the slab with a prescribed pressing force while rotation axes are kept parallel to each other during casting. The reaction force from the slab on the casting drums changes in accordance with the solidification state and may be non-uniform in a width direction in some cases. In addition, it is difficult to keep the rotation axes of the pair of casting drums strictly parallel to each other. For this reason, differences between plate thickness at both end portions of the slab in the width direction, so-called wedges, may be generated in the slab in some cases. If wedges are generated, meandering may occur in a rolling mill located downstream of the casting drums in a casting direction in some cases, which may cause plate passing trouble in some cases.

For example, as a method for minimizing meandering in a rolling mill, Patent Document 1 discloses a technique for performing adjustment with respect to crowns and wedges of the slab by controlling opening/closing, a crossing angle, and an offset amount of each of the pair of casting drums while the casting drums are kept parallel to each other.

Patent Document 2 discloses a screw-down control method for a twin-drum type continuous casting machine which casts a thin plate by casting a molten metal into surface gaps of two drums having parallel rotation axes, having an arbitrary gap held therebetween, and rotating in opposite directions. In such a method, occurrence of wedges are minimized by moving both ends of the other drum in parallel using a hydraulic cylinder so that the pressing forces at both end portions of one of the drums are detected/applied and a sum of the pressing forces at both ends of the one of the drums is a prescribed value using a signal based on the detected/applied pressing forces.

Patent Document 3 discloses a rolling start method in which the passage of a dummy sheet attached to a distal end of a slab sent out from a twin drum is detected using a mill-exit-side plate thickness gauge, and then a roller interval of an in-line mill is narrowed to a target position during rolling. In such a method, meandering of the slab is minimized by changing a roll cross angle or a roll bending force of a rolling mill.

Patent Document 4 discloses a technique relating to a meandering control method for controlling meandering of a thin strip slab manufactured using a twin-drum type continuous casting machine. In such a method, meandering of the thin strip slab is minimized by adjusting a difference between left and right gaps in a hot rolling mill on the basis of a difference in amounts of meandering of the slab detected at two or more points on an entry side of a rolling mill.

Also, Patent Document 5 discloses a technique relating to a control method for the purpose of controlling meandering in a rolling mill. The method of this document discloses a technique for controlling a wedge ratio between an entry-side and an exit-side based on a plate thickness detected by a sensor provided between rolling stands.

Furthermore, Patent Document 6 discloses that a plate thickness is estimated by separating mill stretching into amounts from each of the contribution from working roller deformation and the contribution from deformations other than that of a work roll when a plate thickness is obtained in a case in which a plate thickness gauge is not installed in a screw-down setting control method for a rolling mill.

CITATION LIST

Patent Document

[Patent Document 1]
Japanese Unexamined Patent Application, First Publication No. 2017-196636
[Patent Document 2]
Japanese Unexamined Patent Application, First Publication No. H01-166863
[Patent Document 3]
Japanese Unexamined Patent Application, First Publication No. 2000-343103
[Patent Document 4]
Japanese Unexamined Patent Application, First Publication No. 2003-039108
[Patent Document 5]
Japanese Unexamined Patent Application, First Publication No. H09-168810
[Patent Document 6]
Japanese Unexamined Patent Application, First Publication No. S60-030508

SUMMARY

Problems to be Solved

In order to control and minimize wedges which can cause meandering with high precision, as in the technique described in Patent Document 1, it is conceivable to install a thickness distribution meter or the like configured to measure a plate thickness downstream of casting drums in a casting direction and to perform feedback control to control the plate thickness using the measurement results through the thickness distribution meter. At this time, in order to reduce a dead time until a measured value of a thickness is reflected in the control of the wedges, it is desirable that the thickness distribution meter be installed as close to a casting device as possible. However, if the thickness distribution meter is installed directly under the casting device, when a molten metal fails to be extracted, the molten metal is likely to fall on the thickness distribution meter and damage the thickness distribution meter. For this reason, the thickness distribution meter needs to be installed at a certain distance from the casting drums. As the thickness distribution meter becomes further away from the casting drums, the dead time until the measured value of the thickness distribution meter is reflected in wedge control increases. Thus, it is difficult to control the wedges through feedback control with high precision.

Also, in the technique described in Patent Document 2, the rigidities at both end portions of the casting drums are not the same all the time. In addition, even if the casting drums are moved in parallel to each other using a hydraulic cylinder so that the rigidity thereof has a sum of pressing forces as a target, wedges cannot be reduced and meandering cannot be minimized all the time.

Patent Document 3 does not disclose the reduction of wedges, and even if an attempt were to be performed to minimize wedges using the technique described in Patent Document 3, when the wedges are large, a plate passing trouble due to meandering or narrowing is likely to occur in some cases.

In the technique described in Patent Document 4 or Patent Document 5, left and right screw-down positions of a work roll cannot be set appropriately. Thus, non-uniformity of a forward-moving rate and a rearward-moving rate occurs on the left and right of the rolling mill and material speeds on the left and right on the entry side of the rolling mill are non-uniform. Although an amount of meandering on the entry side of the rolling mill due to a difference between the material speeds is determined, it takes time for a difference between material speeds occurring due to a screw-down position of a work roll after the screw-down position is set to appear in an amount of meandering. For this reason, even if meandering control is performed, the control is not be performed in time, which is likely to lead to a plate passing trouble.

Therefore, the present disclosure was made in view of the above problems, and an object of the present disclosure is to provide a new and improved casting method and control device for a slab capable of further reducing meandering of a rolling mill and reducing a plate passing trouble when the slab is manufactured in a continuous casting facility having a twin-drum type continuous casting device and a rolling mill.

Means for Solving the Problem (1) A slab manufacturing method according to an aspect of the present disclosure is a slab manufacturing method for manufacturing a slab using a twin-drum type continuous casting device configured to cast a slab by solidifying a molten metal using a pair of rotating casting drums; and a rolling mill configured to roll the cast slab using a pair of work rolls, including: calculating estimated plate thicknesses at both of end portions of the slab in a width direction from the following Expression 1 using casting drum housing screw-down system deformation characteristics acquired prior to the start of slab casting indicating deformation characteristics of housings configured to support the casting drums and deformation characteristics of a screw-down system configured to screw down each of the casting drums; calculating an entry-side wedge ratio indicating a ratio of an entry-side wedge which is a difference between plate thicknesses at both of the end portions on an entry side of the rolling mill to an entry-side plate thickness of the slab on the basis of the estimated plate thicknesses calculated from Expression 1; calculating an exit-side wedge ratio indicating a ratio of an exit-side wedge which is a difference between plate thicknesses at both of the end portions on an exit side of the rolling mill to an exit-side plate thickness of the slab; and adjusting a screw-down position of the rolling mill so that a difference between the entry-side wedge ratio and the exit-side wedge ratio is within a prescribed range:

(Estimated plate thickness on entry side of rolling mill) = Expression 1

(Screw-down position of casting cylinder)

+(Elastic deformation of casting drum)
+(Casting drum housing screw-down system deformation)
+(Drum profile of casting drum)
−(Elastic deformation of casting drum at the time of screw-down position zero-point adjustment).

(2) In the slab manufacturing method according to (1), the exit-side plate thickness used for calculating the exit-side wedge ratio may be estimated through the following Expression 2 using position information regarding the slab in the width direction directly under a roll bite:

(estimated plate thickness on exit side of rolling mill) = Expression 2

(screw-down position of rolling cylinder)

+(work roll elastic deformations)
+(rolling mill housing screw-down system deformation)
+(roll profile of work roll)
−(elastic deformation of work roll at the time of screw-down position zero-point adjustment).

(3) In the slab manufacturing method according to (1), the exit-side plate thickness used for calculating the exit-side wedge ratio may be an actually measured value of the plate thickness of the slab on the exit side of the rolling mill.

(4) In the slab manufacturing method according to any one of (1) to (3), the casting drum housing screw-down system deformation characteristics may be acquired on the basis of a screw-down position and a load of the casting cylinder obtained by performing tightening in a state in which a pair of side weirs provided at end portions of the casting drums in the width direction are open and a plate whose plate width is longer than a drum length of the casting drums and whose plate thickness is uniform is disposed between the casting drums.

(5) In the slab manufacturing method according to any one of (1) to (4), the screw-down position zero-point adjustment of the casting drum may be performed in a state in which the pair of side weirs provided at the end portions of the casting drums in the width direction are open and a plate whose plate width is longer than the drum length of the casting drums and whose plate thickness is uniform is disposed between the casting drums.

(6) A control device according to an aspect of the present disclosure is a control device which adjusts a screw-down position of a rolling mill in a slab manufacturing facility which includes: a twin-drum type continuous casting device configured to cast a slab by solidifying a molten metal using a pair of rotating casting drums; and a rolling mill configured to roll the cast slab using a pair of work rolls, including: a plate thickness calculator which calculates estimated plate thicknesses at both of end portions of the slab in a width direction from the following Expression 1 using casting drum housing screw-down system deformation characteristics acquired prior to the start of slab casting indicating deformation characteristics of housings configured to support the casting drums and deformation characteristics of a screw-down system configured to screw down the casting drums; a ratio calculator which obtains an entry-side wedge ratio indicating a ratio of an entry-side wedge which is a difference between plate thicknesses of both of the end portions on an entry side of the rolling mill to an entry-side plate thickness of the slab using the estimated plate thicknesses, and which obtains an exit-side wedge ratio indicating a ratio of an exit-side wedge which is a difference between plate thicknesses at both of the end portions on an exit side of the rolling mill to an exit-side plate thickness of the slab; and a controller which adjusts a screw-down position of the rolling mill so that a difference between the entry-side wedge ratio and the exit-side wedge ratio is within a prescribed range;

(estimated plate thickness on entry side of rolling mill) = Expression 1

(screw-down position of casting cylinder)

+(elastic deformation of casting drum)
+(casting drum housing screw-down system deformation)
+(drum profile of casting drum)
−(elastic deformation of casting drum at the time of screw-down position zero-point adjustment).

Effects

According to the present disclosure, it is possible to further reduce meandering in a rolling mill and reduce a plate passing trouble when a slab is manufactured in a continuous casting facility having a twin-drum type continuous casting device and the rolling mill.

DESCRIPTION OF EMBODIMENTS

Figure 1:
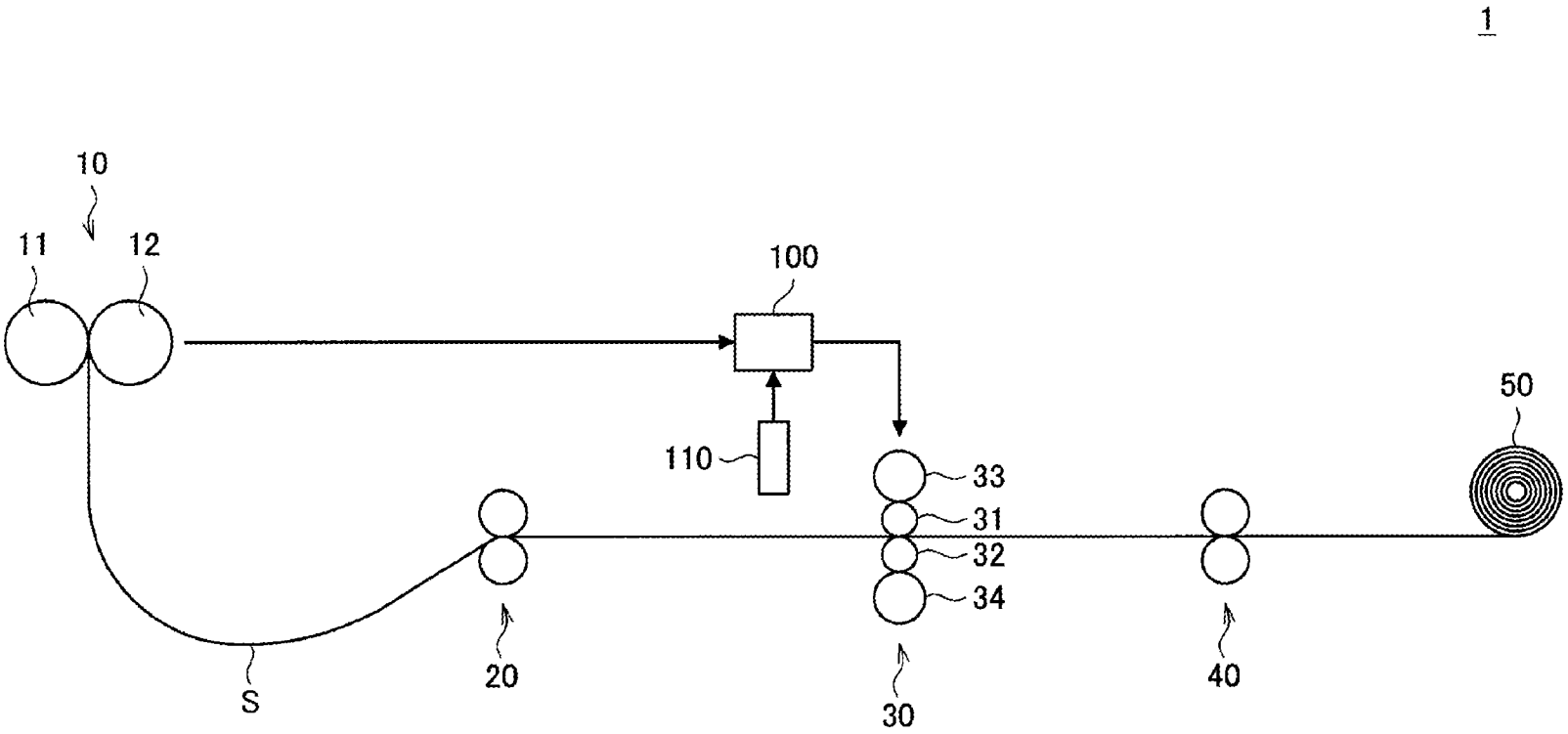
FIG. 1 is a schematic cross-sectional view illustrating a slab manufacturing facility according to an embodiment of the present disclosure.

Preferred embodiments of the present disclosure will be described in detail below with reference to the accompanying drawings. In this specification and the drawings, constituent elements having substantially the same functional constitution will be denoted by the same reference numerals and duplicate description thereof will be omitted.

In this specification, a numerical range represented using the word "to" refers to a range including numerical values stated before and after the word "to" as a lower limit value and an upper limit value. In this specification, the term "process" is used not only to mean an independent process and also includes a process which cannot be clearly distinguished from other processes as long as an intended purpose of the process is achieved. Furthermore, it is obvious that constituent elements of the following embodiments can be combined.

1. Continuous Casting Facility

Figure 2:
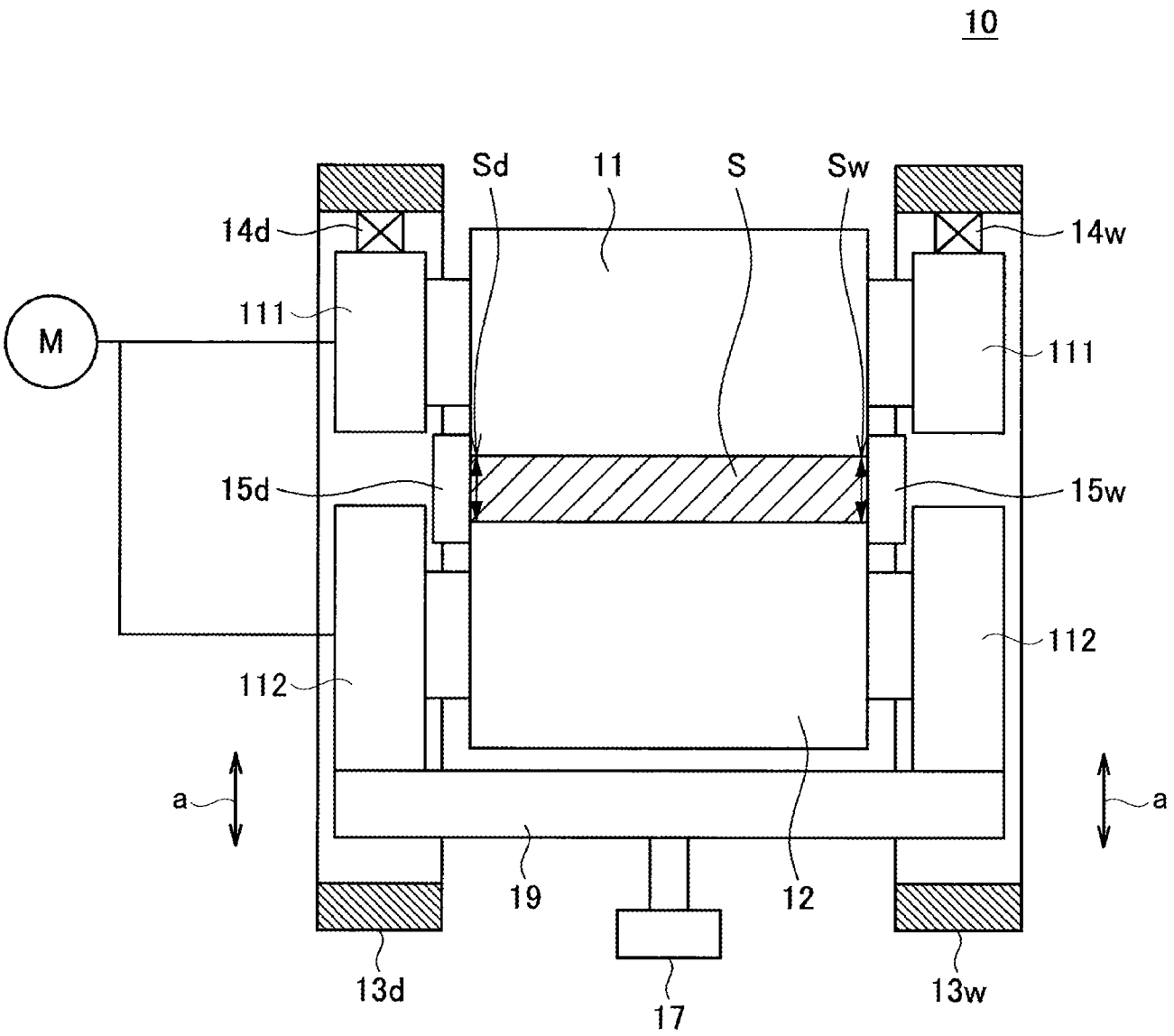
FIG. 2 is a schematic diagram illustrating an example of a constitution of casting drums.

An example of a constitution of a continuous casting facility configured to manufacture a slab will be described with reference to FIGS. 1 and 2. FIG. 1 is a diagram illustrating a continuous casting facility 1 configured to manufacture a slab. FIG. 2 is a plan view illustrating an example of a constitution of a continuous casting device 10 when viewed from directly above in a casting direction.

Referring to FIG. 1, the continuous casting facility 1 includes the twin-drum type continuous casting device 10 (hereinafter referred to as a "continuous casting device 10"), a first pinch roll 20, a rolling mill 30, a control device 100, a meandering meter 110, a second pinch roll 40, and a winding device 50.

The continuous casting device 10 includes a pair of casting drums including a first casting drum 11 and a second casting drum 12. The pair of casting drums are arranged to face each other in a horizontal direction. The continuous casting device 10 continuously casts a slab S by rotating the first casting drum 11 and the second casting drum 12 in different circumferential directions so that facing surfaces of the pair of casting drums extend downward and cooling and solidifying a molten metal injected into a molten metal pool part formed by the circumferential surfaces of these casting drums on the circumferential surfaces of the casting drums.

Here, a constitution of the continuous casting device 10 will be described with reference to FIG. 2. Referring to FIG. 2, in the continuous casting device 10, the first casting drum 11 and the second casting drum 12 are arranged to face each other in the horizontal direction and a slab is cast between the first casting drum 11 and the second casting drum 12.

The first casting drum 11 and the second casting drum 12 rotate through the driving of a motor M and send out the slab S downstream in the casting direction.

The continuous casting device 10 includes a side weir 15*d* and a side weir 15*w* formed at both end portions of the first casting drum 11 and the second casting drum 12 in a width direction so that the side weir 15*d* and the side weir 15*w* surround a gap formed by the first casting drum 11 and the second casting drum 12 facing each other. A molten metal is stored in a region surrounded by the first casting drum 11, the second casting drum 12, the side weir 15*d*, and the side weir 15*w* and slabs S are sequentially cast.

Both end portions of axles of the first casting drum 11 and the second casting drum 12 in the width direction are supported by a housing 13*d* and a housing 13*w*. In both end portions of the axle of the second casting drum 12, a joining part 19 configured to join both end portions of the axle of the second casting drum 12 is provided on a side opposite to a side on which the first casting drum 11 is arranged in the horizontal direction in which the casting drums face. The joining part 19 is connected to a cylinder 17 on a side opposite to a side on which the second casting drum 12 is arranged. The cylinder 17 can screw down each of the casting drums in the horizontal direction in which the casting drums face. When the cylinder 17 screws down the joining part 19, the second casting drum 12 can move in the horizontal direction in which the casting drums face. When the second casting drum 12 moves, the slab S can be screwed down using the first casting drum 11 and the second casting drum 12.

A load cell 14*d* and a load cell 14*w* configured to measure a load applied to the first casting drum 11 are provided at both end portions of the axle of the first casting drum 11 opposite to a side on which the cylinder 17 is arranged. Thus, it is possible to measure a load due to the screw-down of the cylinder 17.

The cast slab S is sent from the continuous casting device 10 to the rolling mill 30 using the first pinch roll 20.

The rolling mill 30 rolls the slab S such that it has a desired plate thickness. The rolling mill 30 includes an upper work roll 31, a lower work roll 32, and an upper backup roll 33 and a lower backup roll 34 configured to support the upper work roll 31 and the lower work roll 32. The rolling mill 30 screws down the slab S so that the slab S is arranged between the upper work roll 31 and the lower work roll 32.

The control device 100 and the meandering meter 110 are provided upstream of the rolling mill 30 illustrated in FIG. 1 in a rolling direction thereof. The meandering meter 110 has a function of acquiring position information regarding the slab S with respect to a work roll of the rolling mill 30. The meandering meter 110 also has a function of outputting the acquired position information to the control device 100.

The meandering meter 110 may be, for example, an imaging device such as a camera. In this case, it is possible to acquire position information regarding the slab S by performing image processing on a captured image. Although the meandering meter 110 has been utilized as an example to acquire the position information in this embodiment, a form of the position information is not limited as long as the form can acquire position information. For example, position information regarding the slab S may be acquired using a thermometer in a width direction instead of the meandering meter 110 or position information regarding the slab S may be acquired by installing a split type looper in a pass line of the slab S and utilizing the tension obtained from the looper.

Also, although the meandering meter 110 is installed upstream of the rolling mill 30 in the rolling direction thereof in this embodiment, the meandering meter 110 may be installed downstream in the rolling direction thereof. A place in which the meandering meter 110 is installed is upstream or downstream of the rolling mill 30 in the rolling direction thereof. In addition, when the place is closer to the rolling mill 30, it is possible to quickly acquire position information regarding the slab S.

The control device 100 includes a plate thickness calculator, a ratio calculator, and a controller. The control device 100 has a function of acquiring position information regarding the slab S in the width direction from the meandering meter 110 and controlling the rolling mill 30 on the basis of the position information. Details of an operation of the control device 100 will be described later.

The rolling mill 30 is controlled by the control device 100. The control device 100 controls screw-down positions of the upper work roll 31 and the lower work roll 32 on the basis of the measurement results of the meandering meter 110, for example, when the slab S is rolled.

The slab S rolled by the rolling mill 30 to have a desired plate thickness is sent to the winding device 50 using the second pinch roll 40 and is wound in a coil shape using the winding device 50.

2. Method for Rolling Slab

A method for rolling a slab described in the following description relates to a technique for further reducing meandering of a slab using a rolling mill and reducing a plate passing trouble in a continuous casting facility having a twin-drum type continuous casting device and a rolling mill.

Figure 3:
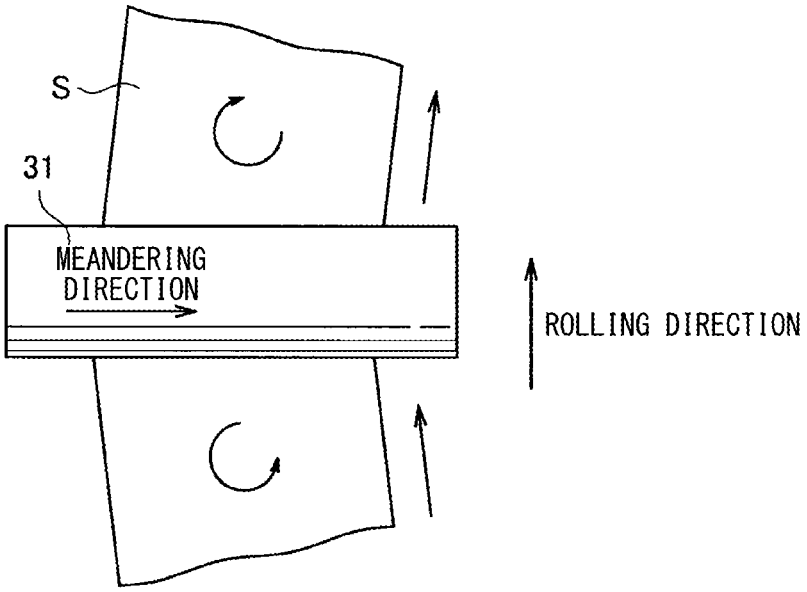
FIG. 3 is a schematic diagram illustrating a state of meandering in a rolling mill.
Figure 4:
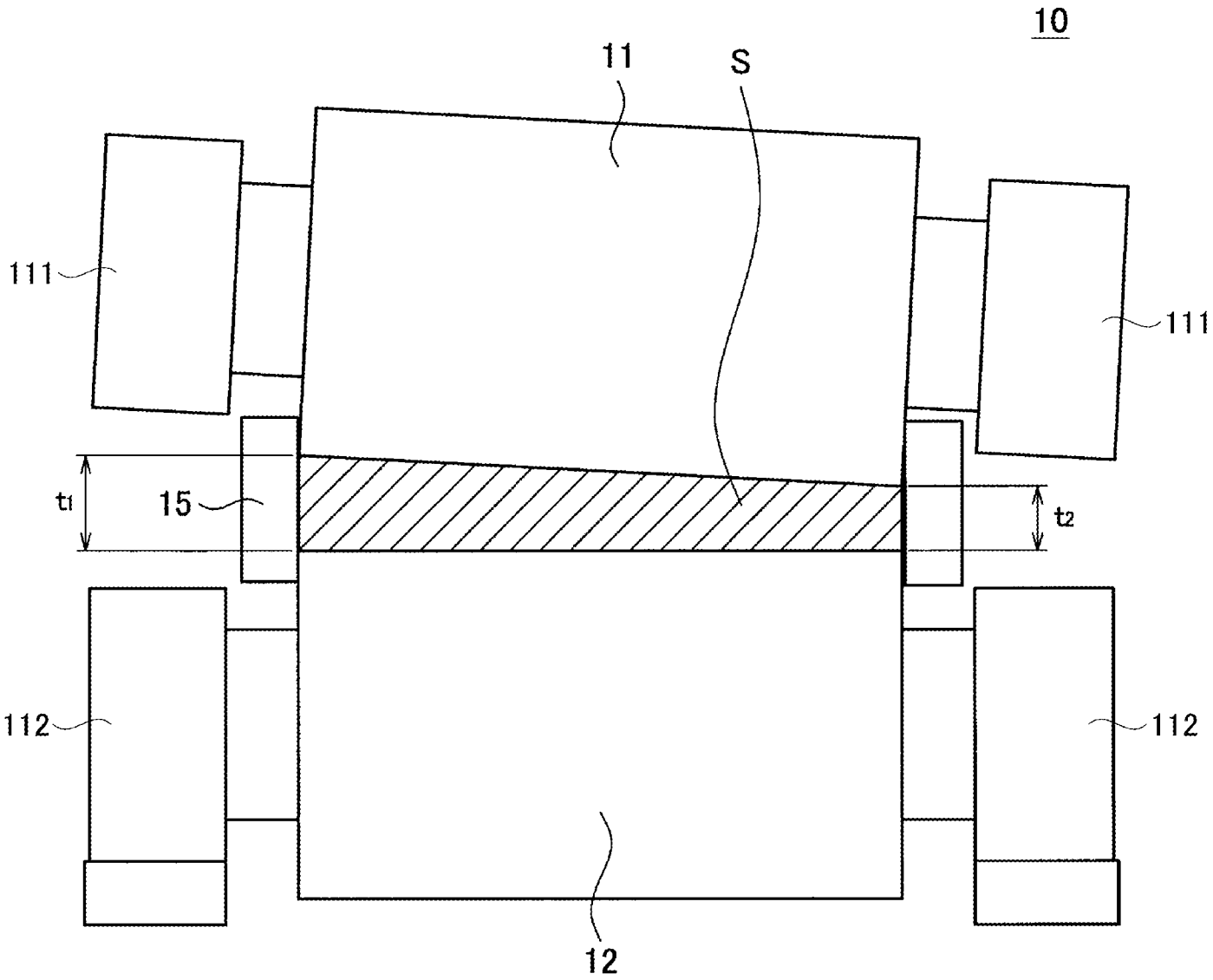
FIG. 4 is a schematic diagram illustrating an example in which a wedge is generated due to casting drums.

The meandering in the rolling mill 30 will be described with reference to FIGS. 3 and 4. FIG. 3 is a schematic plan view illustrating a state of meandering of a slab S in the rolling mill 30 and is a diagram of a plate surface of the slab S when viewed from the upper work roll 31 side. FIG. 4 is a schematic plan view illustrating a state in which a slab having a wedge generated therein is cast.

Referring to FIG. 3, the slab S rolled using the upper work roll 31 and the lower work roll 32 does not move forward parallel to the rolling direction and has meandering occurring so that a plate passing position of the slab moves in a direction perpendicular to the rolling direction. The meandering is caused by asymmetric rolling of one ends and the other ends, that is, the lefts and rights, of the upper work roll 31 and the lower work roll 32. Such meandering of the slab S can occur due to a shape of a plate thickness of the slab S prior to the slab is rolled using the rolling mill 30, that is, at the time of casting.

For example, as illustrated in FIG. 4, the continuous casting device 10 may cast a slab S whose plate thickness gradually changes from one end portion thereof in the width direction toward the other end portion thereof in some cases. A plate thickness $t_1$ of one end portion of the slab S of FIG. 4 is thicker than a plate thickness t2 of the other end portion thereof.

If the slab S whose plate thickness is not uniform and in which the wedges are generated in this way is rolled using the rolling mill 30, a portion thereof in which the plate thickness is thick stretches more than a portion thereof in which the plate thickness thereof is thin. On an entry side of the rolling mill 30, a reduction ratio at an end portion on the plate thickness $t_1$ side in the rolling mill 30 is larger than on the plate thickness t2 side. In this case, a material speed at the end portion on the $t_1$ side on the entry side of the rolling mill 30 of the slab S at the time of rolling is smaller than on the plate thickness t2 side on the entry side. In this way, when a difference in material speed between one end and the other end of the slab S, that is, the rotation of the slab S in a plane occurs, meandering occurs. In order to reduce the occurrence of meandering, it is effective to minimize the difference in material speed between one end and the other end of the slab S as described above and to roll the slab so that the slab has a desired exit-side plate thickness.

The inventors of the present disclosure have diligently studied a rolling method for rolling a slab S so that the slab S has a desired exit-side plate thickness by minimizing a difference in material speed between one end and the other end of the slab S and have found a rolling method in which meandering in the rolling mill 30 is minimized and a plate passing trouble is minimized. A description will be provided with reference to FIG. 5.

Figure 5:
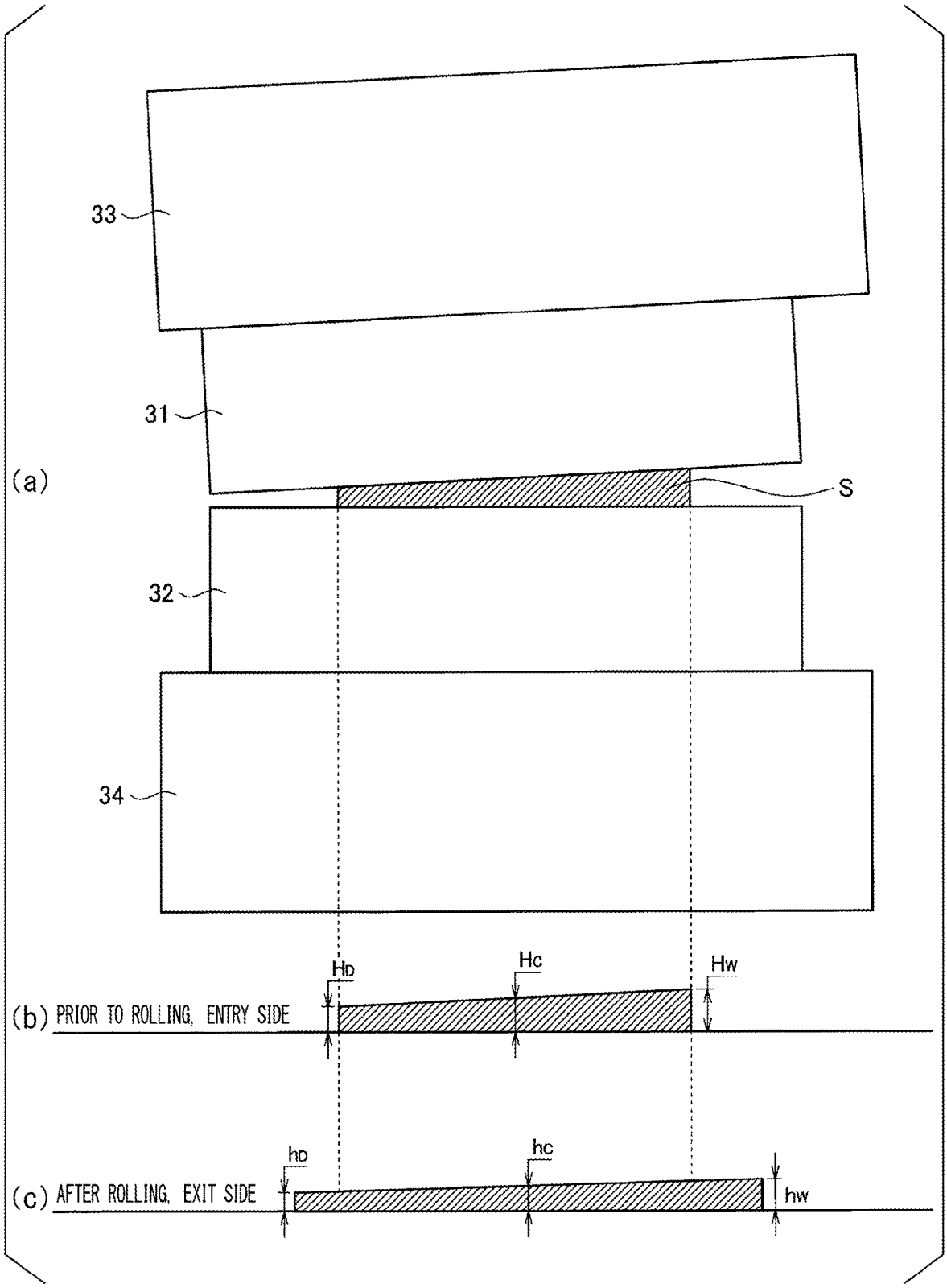
FIG. 5 is a schematic diagram illustrating a state of rolling used for reducing meandering in the rolling mill.

(a) of FIG. 5 illustrates a state in which a slab S in which wedges are generated is rolled in the rolling mill 30 and a cross section of the slab S in the width direction on the entry side and an exit side of the rolling mill 30. FIG. 5 is an example of a cross-sectional view of a slab in which meandering occurs in a longitudinal direction (a transportation direction) when viewed in a cross-sectional view. As illustrated in (b) of FIG. 5, prior to rolling, that is, on the entry side of the rolling mill 30, the slab S has a shape in which a plate thickness $H_D$ at one end of the slab S is thinner than a plate thickness $H_W$ at the other end thereof and a plate thickness thereof gradually changes from one side to the other side in the width direction. When such a slab S is rolled using the rolling mill 30, as illustrated in (c) of FIG. 5, it is assumed that the slab S on the exit side of the rolling mill 30 has, for example, a shape in which one end of the slab S has a plate thickness $h_D$ and the other end thereof has a plate thickness $h_W$.

In the rolling mill 30 according to this embodiment, in order to minimize differences in material speed of the slab S in the width direction occurring at the time of rolling in the rolling mill 30, the slab S in which the wedges are generated is rolled so that reduction ratios of the slab S in the width direction are substantially the same. At this time, a screw-down position of the rolling mill 30 is controlled by acquiring an entry-side wedge ratio ((plate thickness $H_D$-plate thickness $H_W$)/entry-side plate thickness) and an exit-side wedge ratio ((plate thickness $h_D$_plate thickness $h_W$)/exit-side plate thickness) and by determining whether the reduction ratio of the slab S in the width direction is substantially the same from these differences. If it is determined that the reduction ratio of the slab S in the width direction are substantially the same, a difference in material speed of the slab S in the width direction does not occur and the rotation of the slab S in a plane does not occur. Thus, it is possible to minimize the occurrence of meandering in the rolling mill.

In order to realize such a rolling method, the plate thickness calculator of the control device 100 first calculates an entry-side wedge ratio (%) indicating a ratio of an entry-side wedge (plate thickness $H_D$-plate thickness $H_W$) which is a difference in plate thickness between both end portions of a slab S on an entry side of the rolling mill to an entry-side plate thickness of the slab. The entry-side plate thickness of the slab S may be a plate thickness $H_C$ at a center of the slab S in the width direction.

Subsequently, the plate thickness calculator calculates an exit-side wedge ratio (%) indicating a ratio of an exit-side wedge (plate thickness $h_D$-plate thickness $h_W$) which is a difference in plate thickness at both end portions on an exit side of the rolling mill to an exit-side plate thickness of the slab. An exit-side plate thickness of the slab S may be a plate thickness $h_C$ at a center of the slab S in the width direction.

Also, the ratio calculator of the control device 100 acquires a difference between the entry-side wedge ratio (%) and the exit-side wedge ratio (%).

After that, the controller of the control device 100 adjusts a screw-down position of the rolling mill so that the difference is within a prescribed range. The prescribed range of the difference between the entry-side wedge ratio and the exit-side wedge ratio may be empirically obtained from, for example, an amount of meandering which is allowable in an actual operation. The prescribed range may be a value of 0% or more and 2% or less. When an upper limit of a magnitude of the difference is 2%, it is possible to reduce meandering in the rolling mill 30 more reliably. Thus, it is possible to minimize a difference in material speed between one end and the other end of the slab S and to minimize meandering.

Each process will be described in detail below.

(Method for Calculating Rolling Mill Entry-Side Wedge Ratio)

First, a method for calculating an entry-side wedge ratio in the plate thickness calculator will be described. A slab S rolled using the rolling mill 30 is cast using the continuous casting device 10 arranged upstream from the rolling mill 30 in the rolling direction. In this embodiment, a plate thickness of the slab S cast using the continuous casting device 10 is calculated and is used for calculation of the rolling mill entry-side wedge ratio as an entry-side plate thickness of the rolling mill 30. Thus, it is possible to acquire a plate thickness of the slab S on the entry side of the rolling mill 30 even if a plate thickness gauge or the like is not installed on an entry side of the rolling mill 30.

A plate thickness of the slab S on the entry side of the rolling mill 30 is estimated from a drum gap between the casting drums. The drum gap between the casting drums changes in accordance with a load applied to the casting drums, contact with the slab, and the like, in addition to changes due to a cylinder screw-down position. Changes in the drum gap due to the load applied to the casting drums, the contact with the slab, and the like can be considered separately as an amount of contribution of elastic deformation of the casting drums, an amount of contribution of elastic deformation other than that of the drums, and an amount of contribution of changes in drum profile of the casting drums. The amount of contribution of elastic deformation other than that of the casting drums is referred to as "casting drum housing screw-down system deformation". Thus, it is possible to estimate the entry-side plate thickness of the rolling mill 30 from the following Expression 1 using various conditions of the casting drums:

$$\begin{aligned}&(\text{Estimated plate thickness on entry side of rolling mill}) = \\ &(\text{screw-down postion of casting cylinder}) + \\ &(\text{elastic deformation of casting drum}) + \\ &(\text{casting drum housing screw-down system deformation}) + \\ &(\text{drum profile of casting drum}) - \\ &(\text{elastic deformation of casting drum at the time of screw-down} \\ &\qquad \text{position zero-point adjustment}).\end{aligned} \quad \text{Expression 1}$$

Here, in Expression 1, a screw-down position and casting drum housing screw-down system deformation of the casting cylinder represent differences from when the screw-down position zero-point is adjusted. The differences may be differences with respect to the cylinder screw-down position and the casting drum housing deformation at the time of screw-down position zero-point adjustment.

(Screw-Down Position of Cylinder)

The screw-down position of the cylinder indicates a screw-down position of the cylinder 17 in a direction in which the cylinder 17 of the continuous casting device 10 illustrated in FIG. 2 is pressed. For example, the screw-down position of the cylinder indicates a position due to a difference from an initial value which is a zero point at which a position of the cylinder is subjected to zero point adjustment. It is possible to obtain the screw-down position of the cylinder from the displacement in a direction along an arrow a of FIG. 2 or FIG. 7. It is possible to timely measure the screw-down position of the cylinder using a position sensor or the like (not shown) capable of measuring an amount of the cylinder 17 to be moved.

(Elastic Deformation of Casting Drum)

The elastic deformation of the casting drums at the time of casting indicates elastic deformation of the casting drums at any time from the start of casting to the end of casting. In each of the casting drums, the axis of the casting drum is bent or flat deformation occurs in the casting drum due to an influence of a reaction force from the slab in contact with the casting drum and an external force applied to the casting drum. These deformations are referred to as elastic deformations of the casting drum at the time of casting. It is possible to obtain the elastic deformation of the casting drum using a means such as analysis using an elastic theory.

For example, the deflection of the axis of the casting drum due to an amount of contribution of drum deformation of the casting drum can be calculated from the calculation of beam deflection in strength of materials by regarding the casting drum as a support beam for both ends. With regard to a load distribution in the width direction used at the time of calculating deflection, there is no problem if the linear distribution in the width direction is assumed on the basis of load cell values provided at both end portions of the axis of the casting drum.

(Casting Drum Housing Screw-Down System Deformation)

Casting drum housing screw-down system deformation characteristics include deformation characteristics which include characteristics in which the housing 13*d* and the housing 13*w* deform and characteristics in which a constitution in which the casting drum including the cylinder 17 is screwed down deforms under an influence of a screw-down load applied to the casting drum. The casting drum housing screw-down system deformation of the foregoing Expression 1 indicates an amount of casting drum housing to deform calculated using the casting drum housing screw-down system deformation characteristics. For example, the casting drum housing screw-down system deformation characteristics can be obtained using the method described in Patent Document 6. The casting drum housing screw-down system deformation can be calculated on the basis of the load or the like measured by the load cell 14*d* (or the load cell 14*w*) as will be described later.

(Drum Profile of Casting Drum)

A drum profile of the casting drum is an index indicating an amount of thermal expansion of the casting drum or an amount of wear of the casting drum. In the drum profile of the casting drum, for the amount of thermal expansion, an amount of deformation of a surface shape of the casting drum is calculated on the basis of the heat applied to the casting drum. The amount of wear may be obtained by actually measuring the drum profile prior to the casting or estimated from the casting conditions. For example, since a surface shape at the time of designing a casting drum is known, it is possible to obtain an amount of deformation of the drum profile by adding the shape deformation due to thermal expansion and wear to the surface shape thereof.

(Elastic Deformation of Casting Drum at the Time of Screw-Down Position Zero-Point Adjustment)

The elastic deformation of the casting drum at the time of screw-down position zero-point adjustment refers to the elastic deformation of the casting drum at the time of screw-down position zero-point adjustment in which the initial value of the screw-down position of the casting drum is determined prior to the start of casting. Since the screw-down position zero-point adjustment is performed with a load applied to the casting drum, elastic deformation occurs in the casting drum. An amount of elastic deformation at that time is defined as elastic deformation of the casting drum at the time of screw-down position zero-point adjustment. This amount of elastic deformation can be calculated from the calculation of beam deflection in strength of materials in which the drum is regarded as a support beam for both ends, as in the elastic deformation of the casting drum at the time of casting.

As described above, the estimated plate thickness is obtained by subtracting a value of "elastic deformation of the casting drum at the time of screw-down position zero-point adjustment of the casting drum" from a sum of values of a "screw-down position of a casting cylinder", "elastic deformation of the casting drum", "casting drum housing screw-down system deformation", and a "drum profile of the casting drum".

Since the exit-side plate thickness of the continuous casting device 10 due to the gap between the casting drums obtained using the forgoing Expression 1 is equal to the plate thickness of the slab on the entry side of the rolling mill 30, it is possible to acquire plate thicknesses at both end portions of the slab S from the exit-side plate thickness of this continuous casting device 10. Moreover, it is possible to calculate an entry-side wedge ratio from the difference in plate thickness at both end portions of the slab S and the plate thickness at the center of the slab S in the width direction.

(Method for Calculating Rolling Mill Exit-Side Wedge Ratio)

A method for calculating an exit-side wedge ratio of the rolling mill 30 will be described below. The exit-side plate thickness can be estimated using, for example, the following Expression 2 in which a gap between the upper work roll 31 and the lower work roll 32 is calculated. If a distribution of the gap between the upper work roll 31 and the lower work roll 32 in the width direction is grasped, a profile of the slab S rolled using the upper work roll 31 and the lower work roll 32 can also be estimated:

$$\text{(Estimated plate thickness on exit side of rolling mill)} = \text{(screw-down position of rolling cylinder)} + \text{(elastic deformation of work roll)} + \qquad \text{Expression 2}$$

-continued (rolling mill housing screw-down system deformation)+

(roll profile of work roll) −

(elastic deformation of work roll at the time of screw-down position zero-point adjustment)

A screw-down position of a rolling cylinder indicates a position of the cylinder in a direction in which the cylinder configured to screw down the work roll of the rolling mill is screwed down. For example, the screw-down position of the cylinder indicates a position due to a difference from an initial value which is a zero point at which a position of the cylinder is subjected to zero-point adjustment.

The elastic deformation of the work roll indicates the elastic deformation of the work roll at any time from the start of rolling to the end of rolling. In the work roll, the axis of the work roll is bent or flat deformation occurs in the work roll due to an influence of the reaction force from a slab in contact with the work roll or a backup roll and an external force applied to the work roll. These deformations are referred to as "work roll elastic deformations". It is possible to acquire the deflection of the axis of the work roll and the flat deformation of the work roll which are the work roll elastic deformations using, for example, the method described in Patent Document 6.

The rolling mill housing screw-down system deformation characteristics indicate deformation characteristics which include characteristics in which housings configured to support the work rolls and the like deform and characteristics in which a constitution in which the work roll including the cylinder is screwed down deforms under an influence of a rolling load applied to the work roll. For example, it is possible to acquire the rolling mill housing screw-down system deformation characteristics using the method described in Patent Document 6.

The roll profile of the work roll is an index indicating an amount of thermal expansion of the work roll or an amount of wear of the casting drum. In the roll profile of the work roll, for the amount of thermal expansion, an amount of deformation of a surface shape of the work roll is calculated on the basis of the heat applied to the work roll. The amount of wear may be obtained by actually measuring a roll profile prior to rolling or estimated from the rolling conditions. For example, since the surface shape of the work roll at the time of designing the rolling mill is known, it is possible to acquire an amount of deformation of the roll profile by adding the shape deformation due to thermal expansion to the surface shape.

The work roll elastic deformations at the time of screw-down position zero-point adjustment indicate the work roll elastic deformations at the time of screw-down position zero-point adjustment in which the initial value of the screw-down position of the rolling mill is determined prior to the start of rolling. Since the screw-down position zero-point adjustment is performed with a load applied to the work roll, elastic deformation occurs in the work roll. An amount of elastic deformation at that time is defined as the work roll elastic deformations at the time of the screw-down position zero-point adjustment. It is possible to calculate this amount of elastic deformation as in the work roll elastic deformations at the time of rolling.

As described above, the gap between the work rolls on the exit side of the rolling mill is obtained by subtracting a value of "work roll elastic deformation at the time of the screw-down position zero-point adjustment" from a sum of values of a "screw-down position of a rolling cylinder", "work roll elastic deformation", "rolling mill housing screw-down system deformation", and a "roll profile of a work roll".

Here, in order to calculate the wedges of the slab on the exit side of the rolling mill 30, in the foregoing Expression 2, it is necessary to specifically designate a position of the slab S in the width direction with respect to the upper work roll 31 and the lower work roll 32 of the rolling mill 30. This is because the work roll elastic deformations change and a distribution of the gap between the upper work roll 31 and the lower work roll 32 in the width direction changes when a position of a point of action of the reaction force from the slab in contact with the work roll changes or a distribution of the reaction force in the width direction exerted on the work roll from the slab S or the backup roll changes in accordance with the position of the slab S.

Therefore, the plate thickness calculator acquires position information regarding the slab S from the meandering meter 110 and specifically designates a position of the slab S in the width direction with respect to the rolling mill 30. Moreover, the plate thickness calculator calculates the gap between the work rolls corresponding to the position of the slab S in the width direction as an exit-side plate thickness of the slab S from a distribution of the gap between the work rolls acquired using the foregoing Expression 2. Thus, a plate thickness corresponding to both end portions of the slab S is obtained. The plate thickness calculator calculates an exit-side wedge ratio on the basis of the difference in plate thickness at both end portions of the slab S and the plate thickness at the center of the slab in the width direction.

Figure 6:
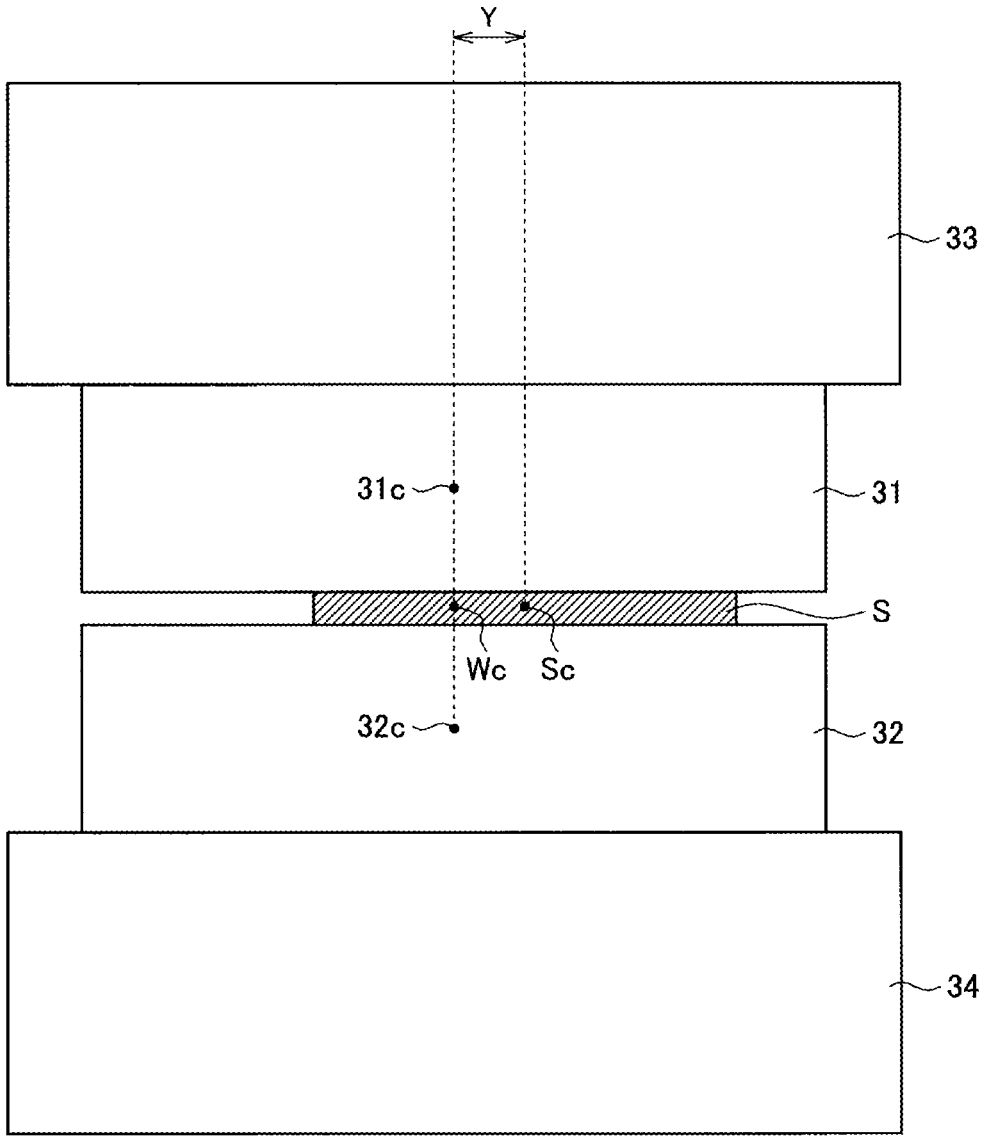
FIG. 6 is a schematic diagram illustrating an example in which position information regarding a slab is acquired in the rolling mill.

The position information of the slab S will be described with reference to FIG. 6. FIG. 6 is a schematic diagram of the rolling mill 30 when viewed in the rolling direction.

The position information is position information of the slab S with respect to the work roll. The position information may be information indicating of a place in which the slab S is in contact with the work roll. To be specific, the position information may be a distance Y from a center point Sc of the slab S in the width direction to a midpoint We of a straight line connecting a center point 31*c* of the upper work roll 31 in the width direction to a center point 32*c* of the lower work roll 32 in the width direction.

In this way, the plate thickness calculator and the ratio calculator calculate the entry-side wedge ratio and the exit-side wedge ratio of the rolling mill 30. The ratio calculator outputs the calculated entry-side wedge ratio and exit-side wedge ratio to the controller.

(Control of Rolling Mill)

The controller acquires the entry-side wedge ratio and the exit-side wedge ratio from the ratio calculator and obtains a difference between the entry-side wedge ratio and the exit-side wedge ratio. The controller adjusts a screw-down position of the rolling mill 30 so that this difference is within a prescribed range. The adjustment of the rolling mill 30 is performed using the cylinder provided in the rolling mill 30. Although the prescribed range (that is, an allowable magnitude of the difference between the entry-side wedge ratio and the exit-side wedge ratio) can be appropriately determined in accordance with a material of the slab, a state of the rolling mill 30, and the like, for example, the prescribed range may be 0% or more and 2% or less. It is possible to more reliably minimize the occurrence of meandering of the rolling mill 30 by setting the magnitude of the difference between the entry-side wedge ratio and the exit-side wedge ratio to 2% or less.

3. Slab Manufacturing Method

With regard to a slab manufacturing method relating to the embodiment, a specific overall procedure will be described below.

First, the plate thickness calculator of the control device 100 calculates an entry-side plate thickness on the entry side of the rolling mill 30. The entry-side plate thickness is calculated on the basis of the foregoing Expression 1. The continuous casting device 10 includes, for example, various measuring instruments such as a temperature measuring instrument for the first casting drum 11 and the second casting drum 12 and the load cell 14*d* and the load cell 14*w* configured to measure a load. The plate thickness calculator acquires various values from these various measuring instruments and calculates estimated plate thicknesses at both end portions of the slab using the forgoing Expression 1. The plate thickness calculator calculates an entry-side wedge using plate thicknesses at both end portions of the slab S having the entry-side plate thickness calculated using the foregoing Expression 1.

Subsequently, the plate thickness calculator calculates an exit-side plate thickness on the exit-side of the rolling mill 30. The exit-side plate thickness is calculated on the basis of the foregoing Expression 2. The rolling mill 30 includes, for example, various measuring instruments such as a temperature measuring instrument for the upper work roll 31 and the lower work roll 32 and a load measuring instrument configured to measure a load. The plate thickness calculator acquires various values from these various measuring instruments and calculates an exit-side plate thickness using the foregoing Expression 2.

Here, the plate thickness calculator calculates position information regarding the slab S from the meandering meter 110. The plate thickness calculator specifically designates a position of the slab S with respect to the work roll using the position information. The plate thickness calculator estimates a plate thickness corresponding to both end portions of the slab S from the specifically designated position of the slab S and the exit-side plate thickness calculated using the foregoing Expression 2 and calculates an exit-side wedge.

Subsequently, the ratio calculator calculates a wedge ratio from the wedges of the slab S on the entry side and the exit side of the rolling mill 30 and the plate thickness of the slab on the entry side and the exit side of the rolling mill 30 which are calculated using the plate thickness calculator. To be specific, the ratio calculator calculates an entry-side wedge ratio using an entry-side wedge and a plate thickness at a center of an entry-side slab in the width direction or an average plate thickness of the entry-side slab and calculates an exit-side wedge ratio using the exit-side wedge and a plate thickness at a center of an exit-side slab in the width direction or an average plate thickness of the exit-side slab.

Subsequently, the controller calculates a difference between the entry-side wedge ratio and the exit-side wedge ratio calculated by the ratio calculator and adjusts a screw-down position of the cylinder (not shown) of the rolling mill 30 so that the difference is within a prescribed range.

Details of the slab manufacturing method in this embodiment have been described above.

4. Improvement of Accuracy of Rolling Mill Entry-Side Plate Thickness Calculation In this embodiment, the plate thickness of the slab S on the entry side of the rolling mill 30 is estimated using various conditions of the casting drum on the basis of the foregoing Expression 1. When the accuracy of estimating the plate thickness using the foregoing Expression 1 increases, the accuracy of the difference between the entry-side wedge ratio and the exit-side wedge ratio increases. As a result, it is possible to further minimize meandering of the rolling mill 30 as well.

Here, among the items of the foregoing Expression 1, the casting drum housing screw-down system deformation characteristics indicating the deformation characteristics of constitutions other than the drums significantly depend on a delicate shape of a contact surface, especially in a low load region. Thus, the characteristics easily change and it is difficult to accurately grasp a geometric shape using a known physical model as well. Thus, the inventors of the present disclosure have studied a method for acquiring the casting drum housing screw-down system deformation characteristics and have come up with the method described below.

(Acquisition of Casting Drum Housing Screw-Down System Deformation Characteristics)

Figure 7:
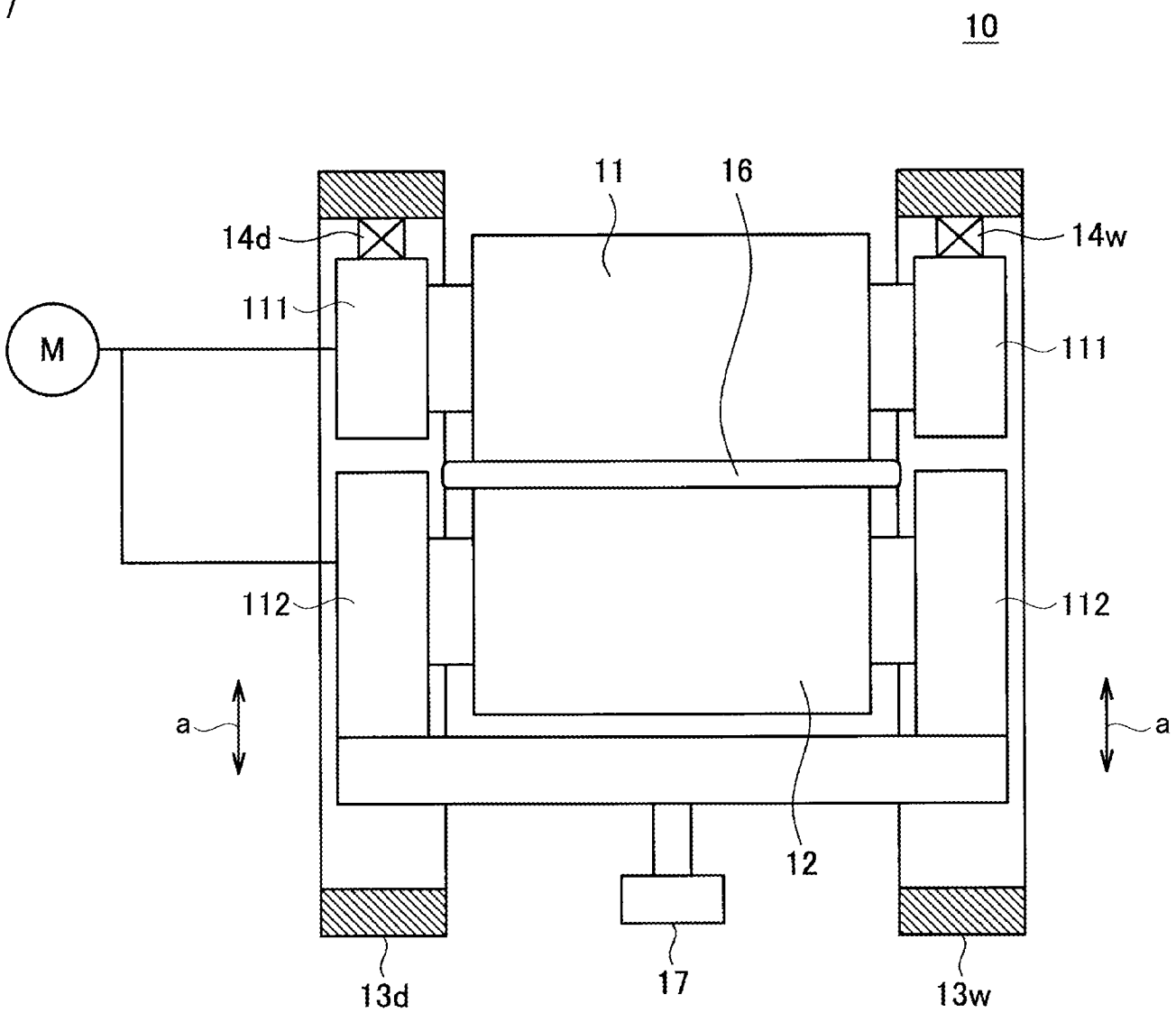
FIG. 7 is a schematic diagram illustrating an example in which a casting drum housing screw-down system deformation characteristic is acquired.

A method for acquiring casting drum housing screw-down system deformation characteristics will be described with reference to FIG. 7. FIG. 7 is a diagram illustrating an example of the method for acquiring the casting drum housing screw-down system deformation characteristics.

As illustrated in FIG. 7, the casting drum housing screw-down system deformation characteristics are acquired by arranging a test plate 16 between the first casting drum 11 and the second casting drum 12. A length of the test plate 16 in a longitudinal direction is longer than a length of a barrel in the width direction of the casting drum and the test plate 16 has a uniform plate thickness. When the test plate 16 is pressed and tightened using the cylinder 17 from this state, the test plate 16 is pressed by the first casting drum 11 and the second casting drum 12. Although a length of the test plate 16 in a direction perpendicular to the longitudinal direction is not limited, it is more desirable that the length thereof be a length of about 50 to 100 cm, which is about twice a drum diameter of the first casting drum 11 and the second casting drum 12 so that the test plate 16 can be sufficiently in contact with the first casting drum 11 and the second casting drum 12.

When the test plate 16 longer than the length of the barrel is utilized in this way, it is possible to apply an even load to both end portions of the casting drum and to obtain the casting drum housing screw-down system deformation with high precision. The casting drum housing screw-down system deformation indicates a relationship between a load change and an amount of deformation of the casting drum housing screw-down system.

To be specific, in a state in which the test plate 16 is arranged between the casting drums, an amount of deformation of the casting drum with each load is calculated by tightening the casting drum with a prescribed load larger than a load at the time of adjusting a zero point with respect to the test plate 16 while the first casting drum 11 and the second casting drum 12 does not rotate and obtaining the screw-down position of the casting drum and the load measured by the load cells 14*d* and 14*w*. Moreover, a casting drum housing screw-down system deformation amount is obtained with respect to each load by subtracting the amount of deformation of the casting drum from the screw-down position of the casting drum. Thus, it is possible to acquire the casting drum housing screw-down system deformation characteristics indicating the casting drum housing screw-down system deformation amount according to the load applied to the slab S at the time of casting the slab S. Furthermore, as another method, an average value of the load and the screw-down position of the casting drum may be obtained by rotating the first casting drum 11 and the second casting drum 12 in a state in which the test plate 16 arranged between the casting drums, tightening the casting drums with the prescribed load, and holding the load by a prescribed time. After that, furthermore, the average value of a load of another level and the screw-down position of the casting drum may be obtained by changing the load of the casting drum and holding the changed load by a prescribed time. Here, a time at which each load is held may be an amount corresponding to two rotations of the casting drum. In addition, this average value may be calculated from theses time averages by acquiring time series data of the load and the screw-down position. Thus, the casting drum housing screw-down system deformation amount with respect to each load is obtained by calculating the amount of deformation of the casting drum under each load and subtracting the amount of deformation of the casting drum from the screw-down position of the casting drum. In this way, the casting drum housing screw-down system deformation characteristics using the test plate 16 whose length is longer than the length of the barrel of the casting drum in the width direction and whose plate thickness is uniform can be obtained and the amount of deformation of the screw-down system including the casting drum housing, the cylinder, and the like due to the load applied to the casting drum at the time of casting can be obtained so that they are reflected in Expression 1. As a result, it is possible to improve the accuracy of the estimated plate thicknesses obtained using Expression 1.

The casting drum housing screw-down system deformation characteristics need only to be acquired once prior to the start of a series of casting operations. Furthermore, it is possible to acquire the casting drum housing screw-down system deformation characteristics according to the facility conditions by performing the acquiring of the characteristics when a part of the constitution of the housing or the screw-down system is replaced.

It is desirable that the test plate 16 be formed of, for example, a material which is softer than those of the first casting drum 11 and the second casting drum 12 so that dimples or the like formed in surfaces of the first casting drum 11 and the second casting drum 12 are not crushed. Although the test plate 16 is not limited, it is desirable that the test plate 16 be made of, for example, an aluminum alloy.

(Application to Screw-Down Position Zero-Point Adjustment)

Also, in the screw-down position zero-point adjustment of the casting drum, as illustrated in FIG. 7, the casting drums may be tightened by opening a pair of side weirs provided at end portions of the casting drums in the width direction and arranging a plate whose length is longer than a drum length of the casting drums and whose plate thickness is uniform between the casting drums. Thus, since the drums of the slab is tightened in a state in which the rotation axes of the casting drums are kept parallel to each other, it is possible to apply an even load to both end portions of the casting drums and it is possible to improve the accuracy of the estimated plate thickness on the entry side of the rolling mill by improving the accuracy of the screw-down position zero-point adjustment.

In the continuous casting device 10, the screw-down position zero-point adjustment of the casting drum is performed prior to the start of operation. Since the drum gap is estimated in a state in which the plate thickness of the slab rolled using the rolling mill 30 is estimated, it is required that the zero-point adjustment in the casting drum is performed with high precision.

Figure 8:
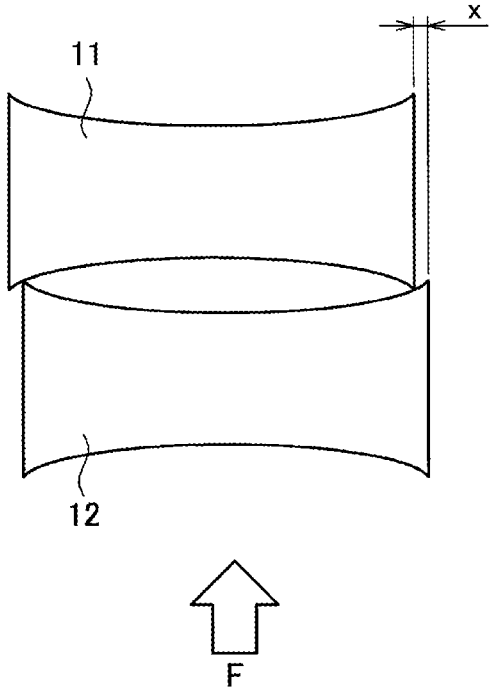
FIG. 8 is a schematic diagram illustrating an example of screw-down position zero-point adjustment for a casting drum.
Figure 9:
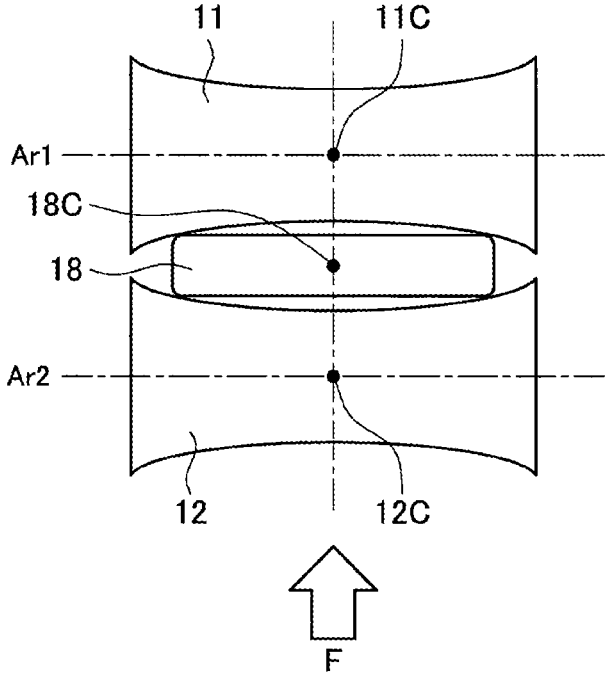
FIG. 9 is a schematic diagram illustrating an example of the screw-down position zero-point adjustment for the casting drum.
Figure 10:
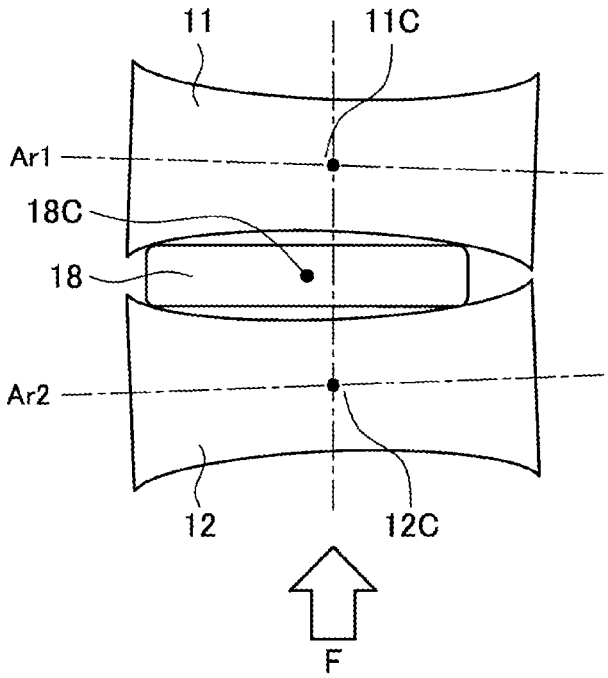
FIG. 10 is a schematic diagram illustrating an example of the screw-down position zero-point adjustment for the casting drum.

First, the screw-down position zero-point adjustment will be described with reference to FIG. 8 to FIG. 10. FIG. 8 to FIG. 10 are schematic diagrams of the casting drums at the time of the screw-down position zero-point adjustment prior to the start of casting. In FIGS. 8 to 10, an emphasized concave shape of a profile is illustrated for the sake of explanation.

As illustrated in FIG. 8 to FIG. 10, the drum profile of the casting drum prior to the start of casting has a concave shape in the width direction of the plate. This is caused by the change due to the elapsed time and the thermal expansion until the first casting drum 11 and the second casting drum 12 reach the steady state of casting from the start of casting. In the casting drum, an initial profile of the casting drum is set so that a plate profile (a crown) of the slab in the steady state of casting in which the thermal expansion is observed is a desired plate profile. That is to say, the initial profile of the casting drum is set to have a concave crown in which a drum diameter of a center portion of the casting drum in a width direction is smaller than drum diameters at both end portions of the casting drum.

In the casting drum in which such a concave crown is provided, the screw-down position zero-point adjustment is performed by setting, to zero, a screw-down position (a pressing position) when a prescribed load F is applied to the pair of casting drums in contact with (kissing) each other. The initial value or the like of the screw-down position of the cylinder configured to press the casting drums can be set through this screw-down position zero-point adjustment.

Incidentally, the concave crown is provided in each of the casting drums as described above. For this reason, when a prescribed load F is applied to the casting drums by bringing the casting drums into contact with (to kiss) each other, only both end portions of the casting drums come into contact with each other. For this reason, for example, as illustrated in FIG. 8, when positions of the casting drums in the width direction do not fully match each other and a prescribed load F is applied to the casting drums, contact points between both end portions of the first casting drum 11 and both end portions of the second casting drum 12 are shifted and an amount of shift x is generated, resulting in an unstable state. For this reason, the accuracy of the screw-down position zero-point adjustment is reduced.

In order to prevent this, at the time of the screw-down position zero-point adjustment in which the casting drums in which the concave crown is provided are utilized, as illustrated in FIG. 9, the screw-down position zero-point adjustment in which a thin plate 18 is arranged between the casting drums is performed. In FIG. 9, an intermediate point 18C of a length of the thin plate 18 in the width direction is arranged on a straight line connecting an intermediate point 11C of a length of the first casting drum 11 in the width direction to an intermediate point 12C of a length of the second casting drum 12 in the width direction. Thus, a shift does not occur at both end portions of the casting drums. If a shift does not occur, a rotation axis Ar1 of the first casting drum 11 is parallel to a rotation axis Ar2 of the second casting drum 12. Thus, it is possible to stably perform the screw-down position zero-point adjustment.

However, even when the thin plate 18 is arranged between the casting drums to minimize a shift and the screw-down position zero-point adjustment is performed, as illustrated in FIG. 10, the intermediate point 18C of the length of the thin plate 18 in the width direction may not be arranged on the straight line connecting the intermediate point 11C of the length of the first casting drum 11 in the width direction to the intermediate point 12C of the length of the second casting drum 12 in the width direction and the thin plate 18 may arranged closer to either end portions of the casting drums in the width direction in some cases. In this case, as illustrated in FIG. 10, the rotation axis Ar1 of the first casting drum 11 is no longer parallel to the rotation axis Ar2 of the second casting drum 12. Thus, even if the screw-down position zero-point adjustment is performed, an error is included on the left sides and the right sides of the casting drums (both end portions of the first casting drum 11 and the second casting drum 12 in the width direction). If an error is included in the screw-down position zero-point adjustment, the screw-down position or the like of the casting drum during casting includes an error. Thus, accuracy is reduced when a plate thickness of the rolling mill 30 is estimated. Therefore, if the accuracy of the screw-down position zero-point adjustment can be improved, it is possible to further reduce meandering in the rolling mill 30.

Thus, as illustrated in FIG. 7, the screw-down position zero-point adjustment is performed in a state in which a pair of side weirs are provided at the end portions of the casting drums in the width direction as in the acquisition of the casting drum housing screw-down system deformation characteristics are opened and the test plate 16 whose plate width is longer than the drum length of the casting drums and whose plate thickness is uniform is arranged between the casting drums. Thus, it is possible to perform the screw-down position zero-point adjustment with high precision. When the screw-down position zero-point adjustment is performed through such a method, the casting drum housing screw-down system deformation characteristics may be acquired in the screw-down position zero-point adjustment.

5. Modified Example

Figure 11:
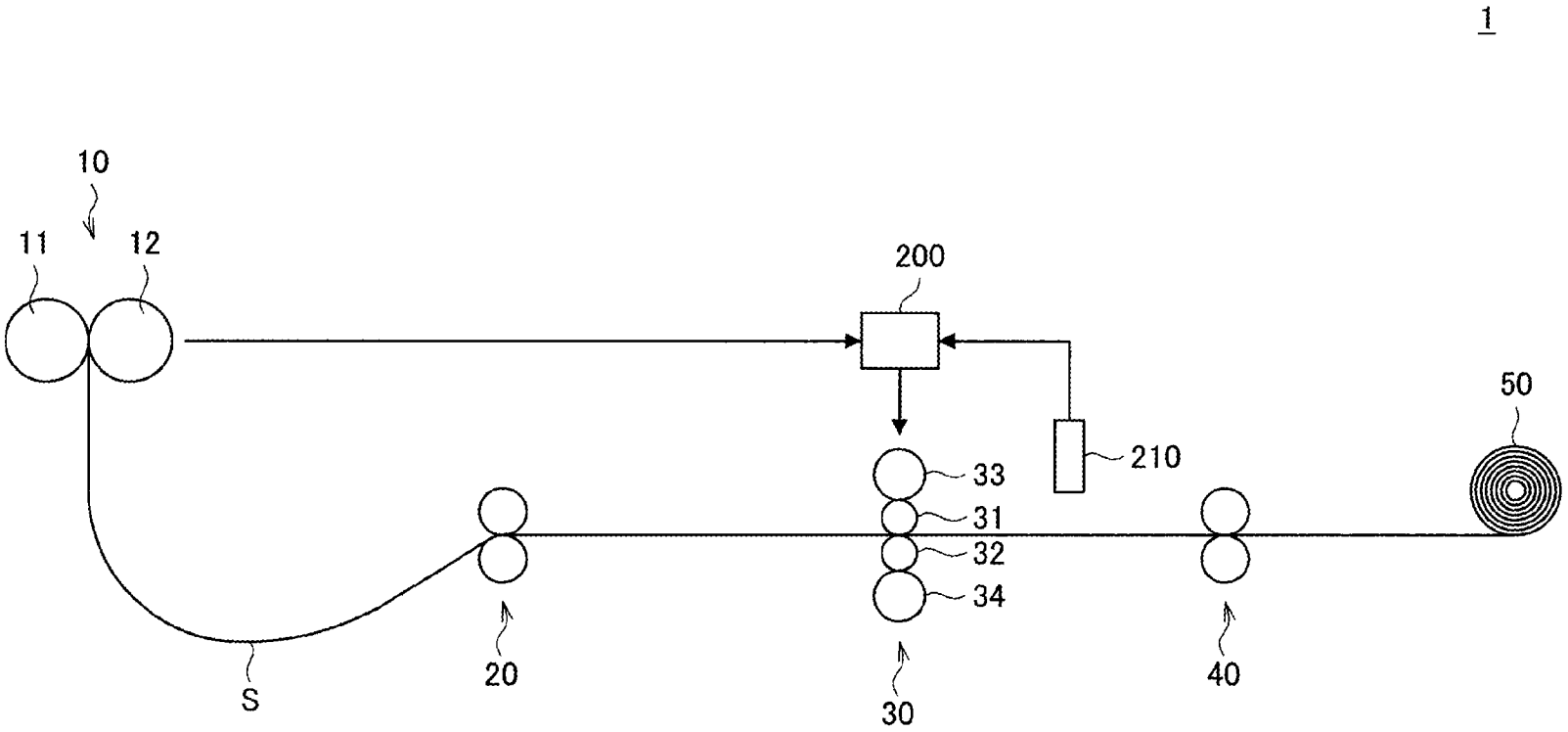
FIG. 11 is a schematic cross-sectional view illustrating an example of a modified example of the slab manufacturing facility according to the embodiment.

An example of a modified example of the slab manufacturing method according to the embodiment will be described below with reference to FIG. 11. FIG. 11 is a diagram illustrating the example of the modified example of the slab manufacturing method according to the embodiment.

A slab manufacturing method in which a continuous casting facility 1 for a slab illustrated in FIG. 11 is utilized differs in that a control device 200 uses an actually-measured plate thickness acquired from a plate thickness gauge 210 at the time of calculating an exit-side wedge instead of the meandering meter 110 illustrated in FIG. 1.

In FIG. 11, the plate thickness gauge 210 is installed downstream from a rolling mill 30 of the continuous casting facility 1 for a slab in a rolling direction. The plate thickness gauge 210 may be, for example, a thickness distribution meter capable of measuring a plate thickness of a slab S in a width direction. In this modified example, an exit-side plate thickness used for calculating an exit-side wedge ratio is an actually measured value of the plate thickness gauge 210 for a slab on an exit side of the rolling mill 30. The control device 200 acquires actually measured values of plate thicknesses at both end portions of the slab S from the plate thickness gauge 210 and obtains an exit-side wedge ratio. The entry-side wedge ratio is obtained in the same manner as in the embodiment. The control device 200 further obtains a difference between the obtained entry-side wedge ratio and exit-side wedge ratio. The control device 200 adjusts a screw-down position of the rolling mill 30 so that the obtained difference is within a prescribed range. Thus, it is possible to control the rolling mill 30 with high precision by minimizing an error in a calculation process and calculating an exit-side wedge. The plate thickness gauge 210 may be installed at least downstream from the rolling mill 30 in the rolling direction.

EXAMPLES

In this example, in order to confirm the effects of the present disclosure, a slab was manufactured using the continuous casting facility 1 illustrated in the embodiment. Casting drums used in this example had a drum barrel length of 1000 mm. Values of a stationary part were used for a cylinder position, pressure, and a plate thickness in the rolling mill. Here, the stationary part means a place in which a change in screw-down position due to control of a screw-down position of left and right cylinders of the rolling mill decreases, which is performed on a material to be rolled so that a difference between the entry-side wedge ratio and the exit-side wedge ratio of the rolling mill decreases. In this example, an average value of each value in a time from after 1 minute 30 seconds had elapsed to after 1 minute 40 seconds had elapsed after the start of rolling was used.

Various conditions and values in each example and comparative example and evaluation of plate-passability are summarized and written in Table 1 below. In the evaluation of plate-passability, a maximum amount of meandering of less 30 mm was evaluated as ○ (good), less than 80 mm was evaluated as ○ (pass), and 80 mm or more was evaluated as x (fail).

In Example 1, as a method for adjusting a screw-down position zero-point of a casting drum, as illustrated in FIG. 7, the screw-down position zero-point adjustment is performed in a state in which a pair of side weirs provided at end portions of the casting drums in a width direction are opened and a plate whose length is longer than a drum length of casting drums and whose plate thickness is uniform is arranged between the casting drums. In Table 1, this screw-down position zero-point adjustment method is written as A. A rolling mill was controlled by controlling a screw-down position of left and right cylinders of the rolling mill so that a difference between an entry-side wedge ratio and an exit-side wedge ratio of the rolling mill decreases.

In Example 2, as a method for adjusting a screw-down position zero-point of a casting drum, the screw-down position zero-point adjustment was performed in a state in which a plate whose length is shorter than a drum barrel length of casting drums as illustrated in FIG. 9 is arranged between a pair of casting drums. In Table 1, this screw-down position zero-point adjustment method is written as B. A rolling mill is controlled by controlling a screw-down position of left and right cylinders of the rolling mill so that a difference between an entry-side wedge ratio and an exit-side wedge ratio of the rolling mill decreases.

In Example 3, as a method for adjusting a screw-down position zero-point of a casting drum, the screw-down position zero-point adjustment was performed in a state in which a plate whose length is shorter than a drum barrel length of casting drums as illustrated in FIG. 9 is arranged between a pair of casting drums. In Table 1, this screw-down position zero-point adjustment method is written as B. A plate thickness gauge was installed on an exit side of the rolling mill. The rolling mill was controlled by controlling a screw-down position of left and right cylinders provided at both end portions of the rolling mill so that a difference between an entry-side wedge ratio and an exit-side wedge ratio is 0.

In Comparative Example 1, as a method for adjusting a screw-down position zero-point of a casting drum, as in Example 2, the screw-down position zero-point adjustment was performed in a state in which a plate whose length is shorter than a drum barrel length of casting drums as illustrated in FIG. 9 is arranged between a pair of casting drums. In Table 1, this screw-down position zero-point adjustment method is written as B. The rolling mill was controlled by controlling a screw-down position of left and right cylinders of the rolling mill so that left and right screw-down forces are the same.

In Comparative Example 2, as a method for adjusting a screw-down position zero-point of a casting drum, as in Example 2, the screw-down position zero-point adjustment was performed in a state in which a plate whose length is shorter than a drum barrel length of casting drums as illustrated in FIG. 9 was arranged between a pair of casting drums. In Table 1, this screw-down position zero-point adjustment method is written as B. The rolling mill was controlled by controlling a screw-down position of left and right cylinders of the rolling mill so that left and right screw-down positions of the rolling mill are the same.

In the slabs relating to Examples 1 to 3 and Comparative Examples 1 and 2, with regard to actually measured plate thicknesses at a stationary part on an entry side of an rolling mill, a plate thickness at an end portion on a drive side DS was 1.760 mm, a plate thickness at an end portion on a work side WS was 1.820 mm, and a wedge (an amount of wedge) was −60 μm. Furthermore, a wedge ratio of an entry-side slab with respect to a plate thickness was −3.35%. The results of manufacturing a slab using each control method will be described below.

In Example 1, the plate thickness at both end portions on the entry side of the rolling mill was estimated using the foregoing Expression 1 and the plate thickness at both end portions on the exit side of the rolling mill was estimated using the foregoing Expression 2. The rolling mill was controlled on the basis of these estimated plate thicknesses. In actually measured values of a slab on the exit side of the rolling mill, a plate thickness at the end portion on the drive side DS on the exit side of the rolling mill was 1.232 mm, a plate thickness at the end portion on the work side WS was 1.287 mm, and a wedge was −55 μm. Furthermore, a wedge ratio of the exit-side slab with respect to the plate thickness was −4.35%. Thus, a difference between the wedge ratios was 0.99%. A maximum amount of meandering in the rolling mill was about 20 mm and rolling could be performed from a distal end portion to a tail end portion of a slab S without any problem.

In Example 2, the plate thickness at both end portions on the entry side of the rolling mill was estimated using the foregoing Expression 1 and the plate thickness at both end portions on the exit side of the rolling mill was estimated using the foregoing Expression 2. The rolling mill was performed on the basis of these estimated plate thicknesses. In actually measured values of a slab on the exit side of the rolling mill, a plate thickness at the end portion on the drive side DS on the exit side of the rolling mill was 1.243 mm, a plate thickness at the end portion on the work side WS was 1.259 mm, and a wedge was −17 μm. Furthermore, a wedge ratio of the exit-side slab with respect to the plate thickness was −1.35%. Thus, a difference between the wedge ratios was 2.00%. A maximum amount of meandering in the rolling mill was about 70 mm and rolling could be performed from a distal end portion to a tail end portion of a slab S without any problem.

In Example 3, the plate thickness at both end portions on the entry side of the rolling mill was estimated using the foregoing Expression 1, the plate thickness at both end portions on the exit side of the rolling mill was actually measured using a plate thickness gauge, and the rolling mill was controlled on the basis of the estimated plate thicknesses and the actually measured plate thickness. In actually measured values of a slab on the exit side of the rolling mill, a plate thickness at the end portion on the drive side DS on the exit side of the rolling mill was 1.232 mm, a plate thickness at the end portion on the work side WS was 1.284 mm, and a wedge was −52 μm. Furthermore, a wedge ratio of the exit-side slab with respect to the plate thickness was −4.13%. Thus, a difference between the wedge ratios was 0.78%. A maximum amount of meandering in the rolling mill was about 15 mm and rolling was performed from a distal end portion to a tail end portion of a slab S without any problem.

In Comparative Example 1, in actually measured values of a slab on the exit side of the rolling mill, a plate thickness at the end portion on the drive side DS on the exit side of the rolling mill was 1.285 mm, a plate thickness at the end portion on the work side WS was 1.238 mm, and a wedge was 47 μm. Furthermore, a wedge ratio of the exit-side slab with respect to the plate thickness was 3.74%. Thus, a difference between the wedge ratios was 7.09%. A maximum amount of meandering in the rolling mill was about 200 mm and narrowing occurred at a tail end portion of a slab S.

In Comparative Example 2, in actually measured values of a slab on the exit side of the rolling mill, a plate thickness at the end portion on the drive side DS on the exit side of the rolling mill was 1.285 mm, a plate thickness at the end portion on the work side WS was 1.219 mm, and a wedge was 65 μm. Furthermore, a wedge ratio of the exit-side slab with respect to the plate thickness was 5.22%. Thus, a difference between the wedge ratios was 8.58%. A maximum amount of meandering in the rolling mill was about 250 mm and a slab came into contact with a side guide on the entry side of the rolling mill and was broken, resulting in breakage.

From the above, when a slab is manufactured using the slab manufacturing facility as described above, it is possible to reduce meandering in the rolling mill and to reduce a plate passing trouble by estimating the plate thickness of the slab S using the casting drum housing screw-down system deformation characteristics acquired prior to the start of slab casting indicating the deformation characteristics of the housings configured to support the casting drums and the deformation characteristics of the screw-down system configured to screw down the casting drums and adjusting the screw-down position of the rolling mill so that the difference between the entry-side wedge ratio and the exit-side wedge ratio of the rolling mill is within a prescribed range.

TABLE 1

| | Zero-point adjustment method | Rolling mill control method | Actually measured plate thickness on entry side of rolling mill DS | Actually measured plate thickness on entry side of rolling mill WS | Entry-side wedge [μm] | Entry-side wedge ratio [%] | Actually measured plate thickness on exit side of rolling mill DS |
|---|---|---|---|---|---|---|---|
| Example 1 | A | Control difference between entry-exit-side wedge ratios to have constant value | 1.760 | 1.820 | −60 | −3.35 | 1.232 |

TABLE 1-continued

| | | | | | | | |
|---|---|---|---|---|---|---|---|
| Example 2 | B | Control difference between entry-exit-side wedge ratios to have constant value | 1.760 | 1.820 | −60 | −3.35 | 1.243 |
| Example 3 | B | Control difference between entry-exit-side wedge ratios to have constant value | 1.760 | 1.820 | −60 | −3.35 | 1.232 |
| Comparative Example 1 | B | Left and right screw-down forces are same | 1.760 | 1.820 | −60 | −3.35 | 1.285 |
| Comparative Example 2 | B | Left and right screw-down forces are same | 1.760 | 1.820 | −60 | −3.35 | 1.285 |

| | Actually measured plate thickness on exit side of rolling mill WS | Exit-side wedge [μm] | Exit-side wedge ratio [%] | Difference between wedge ratios [%] | Evaluation of plate-passability |
|---|---|---|---|---|---|
| Example 1 | 1.287 | −55 | −4.35 | 0.99 | ○ |
| Example 2 | 1.259 | −17 | −1.35 | 2.00 | ○ |
| Example 3 | 1.284 | −52 | −4.13 | 0.78 | ○ |
| Comparative Example 1 | 1.238 | 47 | 3.74 | 7.09 | x |
| Comparative Example 2 | 1.219 | 65 | 5.22 | 8.58 | x |

Although the preferred embodiments of the present disclosure have been described in detail below with reference to the accompanying drawings, the present disclosure is not limited to such examples. It is clear that a person having ordinary knowledge in the field of technology to which the present disclosure belongs can come up with various modifications or modifications within the scope of the technical ideas described in the claims. In addition, it is naturally understood that these also belong to the technical scope of the present disclosure.

INDUSTRIAL APPLICABILITY

According to the present disclosure, since it is possible to further reduce meandering in a rolling mill and to reduce a plate passing trouble when a slab is manufactured in a continuous casting facility having a twin-drum type continuous casting device and a rolling mill, a high industrial applicability is provided.

BRIEF DESCRIPTION OF THE REFERENCE SYMBOLS

10 Continuous casting device
11 First casting drum
12 Second casting drum
20 First pinch roll
30 Rolling mill
40 Second pinch roll
50 Winding device
100 Control device
110 Meandering meter
200 Control device
210 Plate thickness gauge
111, 112 Bearing box (or chock)

The invention claimed is:

1. A slab manufacturing method for manufacturing a slab using a twin-drum type continuous casting device configured to cast a slab by solidifying a molten metal using a pair of rotating casting drums; and a rolling mill configured to roll the cast slab using a pair of work rolls, comprising:

calculating estimated plate thicknesses at both of end portions of the slab in a width direction from Expression 1:

$$\begin{aligned}(\text{estimated plate thickness on entry side of rolling mill}) = {} & (\text{screw-down postion of casting cylinder}) + \\ & (\text{elastic deformation of casting drum}) + \\ & (\text{casting drum housing screw-down system deformation}) + \\ & (\text{drum profile of casting drum}) - \\ & (\text{elastic deformation of casting drum at the time of screw-down position zero-point adjustment})\end{aligned} \quad \text{Expression 1}$$

using casting drum housing screw-down system deformation characteristics acquired prior to the start of slab casting indicating deformation characteristics of housings configured to support the casting drums and deformation characteristics of a screw-down system configured to screw down each of the casting drums;

calculating an entry-side wedge ratio indicating a ratio of an entry-side wedge which is a difference between plate thicknesses at both of the end portions on an entry side of the rolling mill to an entry-side plate thickness of the slab on the basis of the estimated plate thicknesses calculated from the Expression 1;

calculating an exit-side wedge ratio indicating a ratio of an exit-side wedge which is a difference between plate thicknesses at both of the end portions on an exit side of the rolling mill to an exit-side plate thickness of the slab; and adjusting a screw-down position of the rolling mill so that a difference between the entry-side wedge ratio and the exit-side wedge ratio is within a prescribed range.

2. The slab manufacturing method according to claim 1, wherein the exit-side plate thickness used for calculating the exit-side wedge ratio is estimated through Expression 2:

$$\begin{aligned}(\text{estimated plate thickness on exit side of rolling mill}) = {} & (\text{screw-down postion of casting cylinder}) + \\ & (\text{work roll elastic deformations}) + \\ & (\text{rolling mill housing screw-down system deformation}) + \\ & (\text{roll profile of casting drum}) - \\ & (\text{elastic deformation of work roll at the time of screw-down position zero-point adjustment})\end{aligned} \quad \text{Expression 2}$$

using position information regarding the slab in the width direction directly under a roll bite.

3. The slab manufacturing method according to claim 1, wherein the exit-side plate thickness used for calculating the exit-side wedge ratio is an actually measured value of the plate thickness of the slab on the exit side of the rolling mill.

4. The slab manufacturing method according to claim 1, wherein the casting drum housing screw-down system deformation characteristics are acquired on the basis of a screw-down position and a load of the casting cylinder obtained by performing tightening in a state in which a pair of side weirs provided at end portions of the casting drums in the width direction are open and a plate whose plate width is longer than a drum length of the casting drums and whose plate thickness is uniform is arranged between the casting drums.

5. The slab manufacturing method according to claim 1, wherein the screw-down position zero-point adjustment of the casting drum is performed in a state in which the pair of side weirs provided at the end portions of the casting drums in the width direction are open and the plate whose plate width is longer than the drum length of the casting drums and whose plate thickness is uniform is arranged between the casting drums.

6. A control device which adjusts a screw-down position of a rolling mill in a slab manufacturing facility which includes: a twin-drum type continuous casting device configured to cast a slab by solidifying a molten metal using a pair of rotating casting drums; and a rolling mill configured to roll the cast slab using a pair of work rolls, comprising:

a plate thickness calculator which calculates estimated plate thicknesses at both of end portions of the slab in a width direction from Expression 1:

$$\begin{aligned}(\text{estimated plate thickness on entry side of rolling mill}) = {} & (\text{screw-down position of casting cylinder}) + \\ & (\text{elastic deformation of casting drum}) + \\ & (\text{casting drum housing screw-down system deformation}) + \\ & (\text{drum profile of casting drum}) - \\ & (\text{elastic deformation of casting drum at the time of screw-down position zero-point adjustment})\end{aligned} \quad \text{Expression 1}$$

using casting drum housing screw-down system deformation characteristics acquired prior to the start of slab casting indicating deformation characteristics of housings configured to support the casting drums and deformation characteristics of a screw-down system configured to screw down the casting drums;

a ratio calculator which obtains an entry-side wedge ratio indicating a ratio of an entry-side wedge which is a difference between plate thicknesses of both of the end portions on an entry side of the rolling mill to an entry-side plate thickness of the slab using the estimated plate thicknesses, and which obtains an exit-side wedge ratio indicating a ratio of an exit-side wedge which is a difference between plate thicknesses at both of the end portions on an exit side of the rolling mill to an exit-side plate thickness of the slab; and a controller which adjusts a screw-down position of the rolling mill so that a difference between the entry-side wedge ratio and the exit-side wedge ratio is within a prescribed range.

* * * * *